US005493746A

United States Patent [19]

Minakami et al.

[11] Patent Number: 5,493,746

[45] Date of Patent: Feb. 27, 1996

[54] FRAME STRUCTURED BRIDGE

[76] Inventors: Hiroyuki Minakami, 2-1-1 #109 Nishi Okamoto Higashi, Nada-Ku Kobe, Hyogo 658; Motoyuki Minakami, 1-6-16 Agnogi, Matue-Shi, 69, both of Japan

[21] Appl. No.: 455,010

[22] Filed: May 31, 1995

Related U.S. Application Data

[62] Division of Ser. No. 249,154, May 25, 1994.

[30] Foreign Application Priority Data

Jun. 2, 1993 [JP] Japan ..... 5-168296

[51] Int. Cl.[6] ..... E01D 11/00

[52] U.S. Cl. ..... 14/18

[58] Field of Search ..... 14/18–23, 75, 14/77.1, 77.3, 8, 9

[56] References Cited

U.S. PATENT DOCUMENTS

| | | | |
|---|---|---|---|
| 3,979,787 | 9/1976 | Ahlgren | 14/75 |
| 4,069,765 | 7/1978 | Muller | 104/123 |
| 4,208,969 | 6/1980 | Baltensperger et al. | 104/111 |
| 4,253,780 | 3/1981 | Lecomte et al. | 405/202 |
| 4,451,950 | 6/1984 | Richardson | 14/18 |
| 4,457,035 | 7/1984 | Habegger et al. | 14/18 |
| 4,513,465 | 4/1985 | Schambeck | 14/17 |
| 4,535,498 | 8/1985 | Webster | 14/18 |
| 4,589,156 | 5/1986 | Schambeck | 14/4 |

FOREIGN PATENT DOCUMENTS

| | | |
|---|---|---|
| 3-80203 | 12/1991 | Japan . |
| 4-26002 | 5/1992 | Japan . |

OTHER PUBLICATIONS

A. S. Beard, "Development of the Tsing Ma Bridge," The Structural Engineer, pp. 192–195, vol. 71, No. 11, Jun. 1, 1993.

*Primary Examiner*—Michael Powell Buiz
*Attorney, Agent, or Firm*—Limbach & Limbach

[57] ABSTRACT

A suspension bridge structure is disclosed which uses horizontal cables, tensioned between anchorages, and frame lateral girder/node members connected between the horizontal cables to form frames. A tower section protrudes between the horizontal cables and is attached to the horizontal cables. A main cable is extended between the anchorages and over the top of the tower section. The frame lateral girder/node members are suspended from the main cable. A roadway or other transportation system can be supported on the frame lateral girder/node members.

8 Claims, 7 Drawing Sheets

FRAME STRUCTURED BRIDGE

This is a divisional of application Ser. No. 08/249,154, filed May 25, 1994.

BACKGROUND OF THE INVENTION

1. Field of the Invention

The present invention is related generally to bridges, and in particular to a bridge structure which employs frame structures.

2. Description of the Prior Art

Steel, because of its structural strength, has been used for making bridges. Engineers and designers have been trying to elongate the main span between the main towers because there is a demand for such bridges to span wider obstructs such as straits, wide rivers and bays.

Due to present technology and innovation, only suspension bridges and cable stayed bridges are usually used for long spans. The present type of suspension or cable-stayed bridge is designed with a hanging bridge girder. The deck or box shaped girder of present bridge design is installed without input of any stresses except naturally occurring longitudinal direction tension by its dead load. Especially for long bridges, there is a need to consider that the transverse force, which is generated mainly from winds, is the main force acting against the bridge. Also, there are limitations to the hanging method of constructing the girder for suspension or cable-stayed bridges. Herefore, the deck or box shaped girder has potential strength that is under-utilized because the deck or girder box is not stressed or tensioned prior to the installation.

Regarding the concept of these two bridge designs, for example, suspension bridges, the deck or box shaped girder is simply hung from the main cable. This deck or box shaped girder is the only structure against transverse direction force such as strong winds. This does not protect against the transverse direction force. Of course, the cable contributes some degree of transverse direction. However, cables or girders are basically swayable, especially when transverse force is applied because those are just hung, also, in the case of super-long bridges, after construction of the deck or box shaped girder. It is covered and the road is installed. This is how the load weight, which is mainly from vehicles, is sustained.

In the case of cable-stayed type bridge, the skew cable suspended from the main tower has the role of sustaining the deck or box shaped girder can withstand the horizontal force.

The present concept of design, as explained above, requires that the girder becomes large and heavy in order to resist strong horizontal direction forces, such as strong winds. This large and heavy structure requires stronger and heavier cables and limits the length of its span. This is why the present concept of bridge design has a corresponding problem: how can one build much longer bridges with present cable and steel technology without adding to the size and weight of present methodology.

The main reason is that the character of steel, which originally has very strong tensile strength, is not fully utilized. The present design method of long bridges, especially for suspension and cable-stayed bridges, is as follows:

1. The girder is designed based on the stability and strength against the winds.
2. The strength of the suspension main cable design is based on the girder weight which is noted above.

3. The length of the span is determined based on the limit of tension strength of main cable.

Based on our existing theory or concept of designing long bridges, it is anticipated that the present span length limitation of about 2~3 km can now be surpassed.

In addition to the current design problem there is another factor that must be considered.

Usually steel is weaker against compressing forces than against tensile forces. Therefore, the structural steel has to have wider cross section areas to be able to support buckling loads created by a heavier girder structure and protect against strong winds which exert horizontal force on the bridge.

It is clear that if the potential tensile strength of steel is utilized completely against horizontal forces, usually created by strong winds, the minimization of the weight of the girder is possible. When the weight of the girder is diminished, the burden to the main cable is decreased, consequently the central span length can be made much longer. Therefore, in order to design long or super long bridges, the minimization of the girder's weight, through the use of applying potential tensile forces, would be the most important objective.

In addition to the method of how to give the girder pre-tensile force, there is one more aspect which must be considered and that is how to construct those long bridges. According to present construction methods, after hanging each girder, the girders are connected to each other. Because of this, the girders are simply hung to the cable. There is no horizontal direction tension, except the tension of main cable, in the present bridge design system. In fact, as longer bridges are designed, engineers will find that the bridge's span can not be lengthened since the problem just described is not taken into consideration.

As long as the girders are set without horizontal direction tension, the potential strength of steel is not perfectly utilized. A problem occurs because the total strength of the bridge is insufficient. Current bridge design engineering is creating strength of the girder by simply increasing the size of the girder. Therefore, under the present method, to complete the construction of a bridge, more material and expense is required. Consequently the bridge becomes much heavier than an ideal structure which restricts the maximum length of the bridge's span.

Information about the state of the suspension and cable stayed bridge art is provided in the following: U.S. Pat. No. 4,589,156 to Schambeck; U.S. Pat. No. 4,513,465 to Schambeck; U.S. Pat. No. 4,535,498 to Webster; U.S. Pat. No. 4,457,035 to Habegger et al.; U.S. Pat. No. 4,451,950 to Richardson; U.S. Pat. No. 4,253,780 to Lecomte et al.; U.S. Pat. No. 4,208,969 to Baltensperger et al.; U.S. Pat. No. 4,069,765 to Muller; U.S. Pat. No. 3,979,787 to Ahlgren; Japanese Laid Open Applications 4-26002 and 3-80203; and Beard, A. S., "Development of the Tsing Ma Bridge," THE STRUCTURAL ENGINEER, Vol. 71, No. 11, June 1993, pages 192–195.

SUMMARY OF THE INVENTION

The object of this invention is to provide a new concept for designing long bridges. Also, this invention provide how to construct long or super long bridges. This design, by utilizing all of the potential strength, will prevent the problem forces, and will prevent the problems of a weak structure as earlier explained. This will enable longer span lengths to be obtained by using the same amount of material and expense. Also, this invention improves aerodynamical stability and seismic stability of the long span bridge, because the total amount of material can be diminished and as a result, the transverse force which the bridge receives is extensively decreased.

In this invention, pre-tensioned cables receive most of the horizontal force, which is created primarily by strong winds. Also, in order to produce maximum effectiveness, the frame structure is formed parallel to the bridge direction at the point of joint position of the main cable or cable-stayed. This pre-tensioned frame structure is a totally new idea for adding maximum strength to the bridge. The maximum strength of the steel structure is produced by installing pre-tensioned main cables, horizontal cables, upper stayed cables, hanger cables, crossing hangers and down stayed cables.

These pre-tensioned cables are set and fixed in an array at regular intervals along the bridge direction, in other words, the longitudinal direction. In order to install super-high pre-tension to the horizontal cable, it is anchored to the tower or to the base anchorage so the frame structure might be combined with the tower structure.

DETAILED DESCRIPTION

Figure 1:
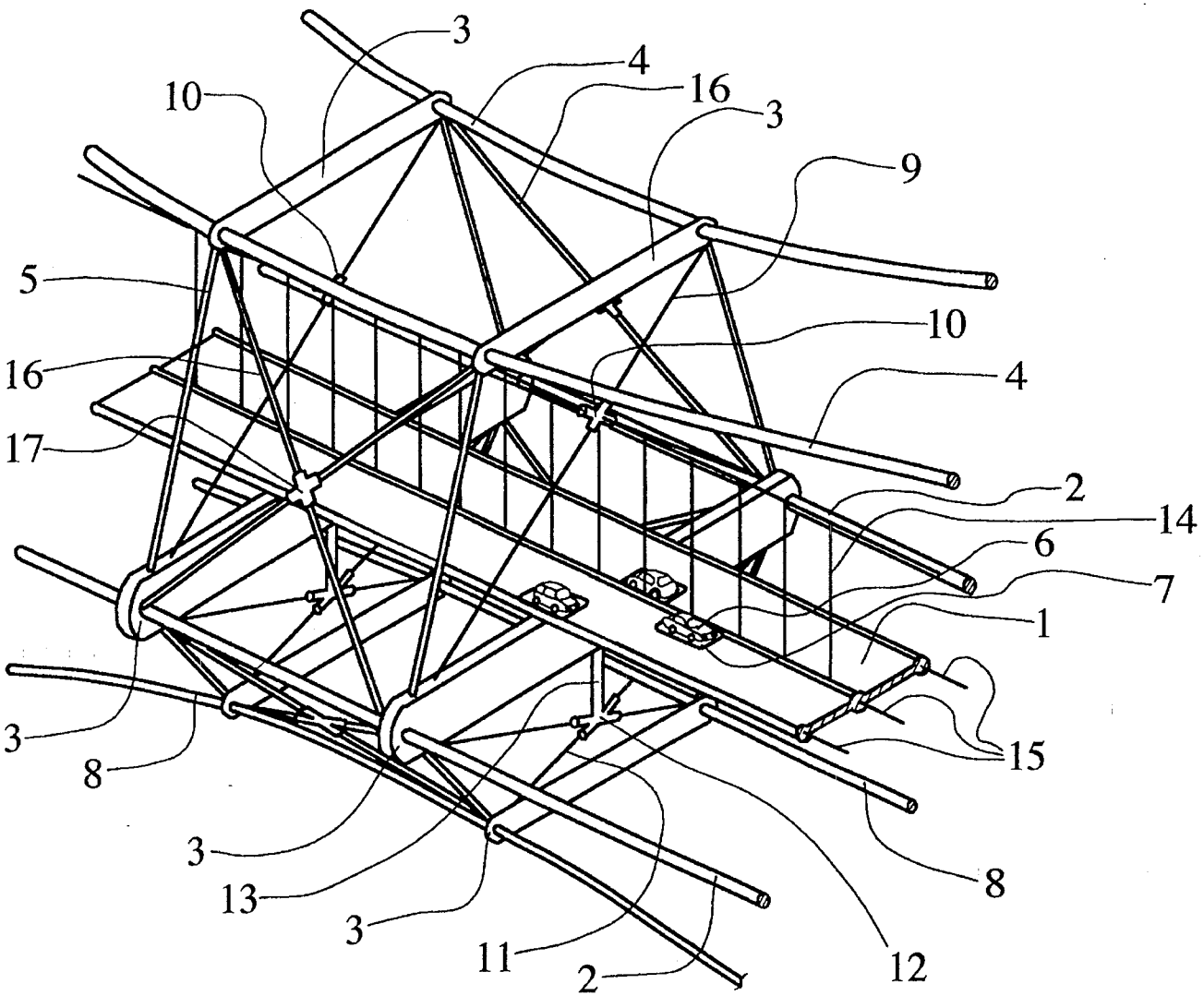
FIG. 1 illustrates a bird's-eye view of a section of the frame structured bridge of the present invention.

The parts or members which are to construct the bridge's structure are set, fixed and highly pre-tensioned. The frame structure is made of appropriate material and is structured to support the maximum force, depending upon the type of force needed to be supported.

If the force is horizontal, the material should have enough strength to resist the compressing force. Most of the compressing forces are put to the main tower and most of the horizontal forces are supported by the frame structure, which has a great deal of pre-tension force. On the other hand, if the force is vertical against the bridge direction, the material should have enough strength to resist the tensile force.

In case of a strong gust of wind batting the bridge, these structures will share the force of the gust. In order to maintain the maximum strength of the characteristic frame structure, it is best if the width of the frame structure is wider than that of the road on the deck. This design enables the building of bridges which will have a much stronger structure against horizontal forces.

By adopting a wider span of the frame structure, geometrical moment of inertia, which is generally induced in proportion to the second power of the distance of the length, of the bridge becomes greater and high tension force is applied into the horizontal cables, main cables, upward stayed cables, downward stayed cables and the like. This causes the structure which forms the frame structure to become highly tensioned. Due to this intentional high tension, the frame structure is very stiff.

The frame lateral girder/node member is set up in the space above the main span. The frame structured lateral girder/node member is put in an orderly position toward the longitudinal direction. The mad and transportation system is installed on the frame lateral girder/node member.

Therefore, even though this invention is for a type of suspension bridge or cable stayed bridge, the frame structured lateral girder/node member is somewhat similar to a steel truss bridge for the road and transportation system. Also, the lateral girder/node member structure is fixed and the road and transportation system is installed on the bridge floor.

In the case of designing bridges with long spans, the stiffness of the bridge is formed by the frame structure and each frame structured lateral girder/node member supports the bridge floor. Thus, the span can be extended by using these frame structured lateral girder/node members.

Under the present design method, after the main cable is installed, the already assembled girder is set by being hung directly to the main cable. According to this invention, all the members of the frame structure are installed to their set location. At the same time, or after placing the members, the horizontal cable is crossed over between anchorages and is connected with the members of the frame structured lateral girder/node member. The horizontal cable is highly tensioned by the anchor.

The result is a highly tensioned frame structure which will have a great deal of stiffness. The back frame structures are arranged across the full span of the bridge.

The horizontal cable is set in an arch in order to keep some degree of clearance from the sea level for the lateral girders/node members by the arch shape. When the horizontal cable is pulled horizontally with high tension, a downward direction force is generated and this force balances well with the upward force from the hanger and the main cable. This is the way to produce a high-tensioned bridge structure.

As explained above, the high tension is formed to the frame structure lateral girders/node members, then the road or transportation system is installed on the bridge floor. The cross-cable is for reinforcement of the frame structure.

In utilizing the invention for a stayed-cable bridge, first the frame structure lateral girder/node member is put at the center of the main span. Then, the horizontal cable is set through the frame structure and is settled with the upward stayed cable to form the total frame structure of the bridge. The horizontal cable is then crossed over between anchorages and/or towers. The tensile force is put to the horizontal cable from the anchor and is strongly tensioned.

DESCRIPTION OF THE PREFERRED EMBODIMENTS

Referring now in detail, to the drawings. FIG. 1 illustrates a section of the frame structured suspension bridge with a bird-eye view. The automobile 6 runs on the road 7 which is installed on the lateral girder/node member. The main cables 4 are hung parallel over the towers, the frame structured lateral girder/node member 3 is installed and attached to the cables 4. In this figure, there are three segments, the first is the upper section which is connected to each main cable 4, the second is the middle section which is connected to each horizontal cable 2, the third is the lower section which is connected to each arch cable 8.

Figure 2:
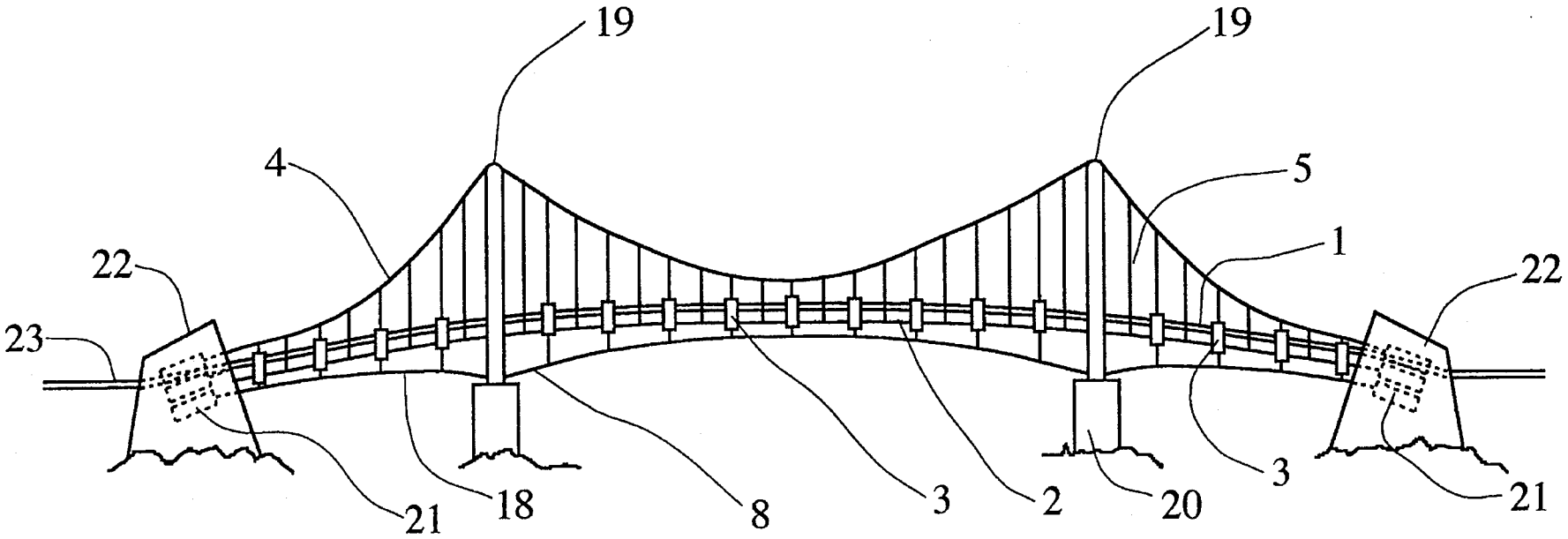
FIG. 2 illustrates another embodiment of the frame structured bridge of the present invention.

The main cable 4, horizontal cable 2 and arch cable 8 are tensioned by anchor of anchorage. These cables are pulled toward each other through the frame structured lateral girder/node member 3, hanger 5 and hanger for the arch cable 18 (FIG. 2). The lateral girder/node member 3 has the function of sustaining the shape of these cables. In the structure of the lateral girder/node member, there are two kinds of places where one is given a compressing force and the other is tensile force. Each frame structured lateral girder/node member 3 becomes a joint node against the longitudinal direction. By changing the span of the lateral girder/node members 3, we can most appropriately control the tension force. For example, when the lateral girder/node member which is in place near by main tower, is larger than the lateral girder/node member which is far from the tower, horizontal cable outlines arch like shape, from the upper view, therefore, we can effectively create maximum tension to the bridge structure. Thereafter, the lateral girder/node member 3 is installed in the bridge structure by the cable which has applied the maximum tensile force.

The cables which are mentioned above, main cable 4, horizontal cable 2, arch able 8, hanger cable 5 and hanger for arch cable 18(FIG. 2), are usually made from steel, however, carbon fiber or newly developed materials can be used as long as the material has enough strength to resist the tensile force.

The reinforcing cable 16 is positioned in between the lateral girder/node members ;t to bolster the lateral girder/node members, especially against the compressing force. The connecting joint 17 for the reinforcing cable 16 links the lateral girder/node member and the cable and also forms the truss structure. The upper cross hanger 9 connects the upper lateral girder/node member 3 and the down lateral girder/node member 3 and is linked by the upper cross hanger 10. With all the linked cross hangers, the total structure becomes resistant to the transverse forces.

The upper cross hangers are connected to each other. Connected hangers are utilized to apply the point for center hanger 14 to hang the bridge floor 1.

According to the invention, a large size of the frame structured lateral girder/node member is installed and extended through the bridge structure, the bridge floor 1 and road 23 are then put onto the structure. The structure receives most of the outer forces, such as winds or earthquakes, thus the bridge will not sway much. Also, the frame structure itself is stiffened and tensioned from several directions by reinforcing cable 16, connecting joint 17 for the reinforcing cable 16, cross hanger 9, upper cross hanger 9, connecting joint 10 for the cross hanger 9, lower cross hanger 11 and connecting joint 12 for lower hanger. Particularly connecting joints 17, 10 and 12 have characteristic functions of preventing deformation of the frame structure, as a result the strength of the structure increases.

The bridge floor 1 is hung between the frame structure 3 by the center cable 14. Meanwhile, as the floor is tensioned by the stiffening cable 15, the cable connects the frame structured lateral girder/node members, similar to how a precast concrete bridge has tensioned strength. If the new transportation system is applied to this invention for a bridge design, it will be the best combination for constructing longer bridges.

By means of FIG. 2, another embodiment of the suspension bridge, according to the invention, is herewith described.

The tower 19 is constructed upon the bridge pier 20. The main cable 4 is suspended. The horizontal cable 2 is fixed to the anchorage 22 by the anchor 21, then pulled to give tension to the cable 2. The bridge floor 1 is installed and supported by the frame structured lateral girder/node members 3. The lateral girder/node member 3 is arranged toward longitudinal direction with a forming joint. Arch cable 8 is given tensile force and this force generates a highly tensioned structure. Hanger 5 and hanger 18 are for the arch cable connection. The horizontal cable and arch cable form frame structure with the lateral girder/node member 3 which is in a longitudinal direction.

Figure 3:
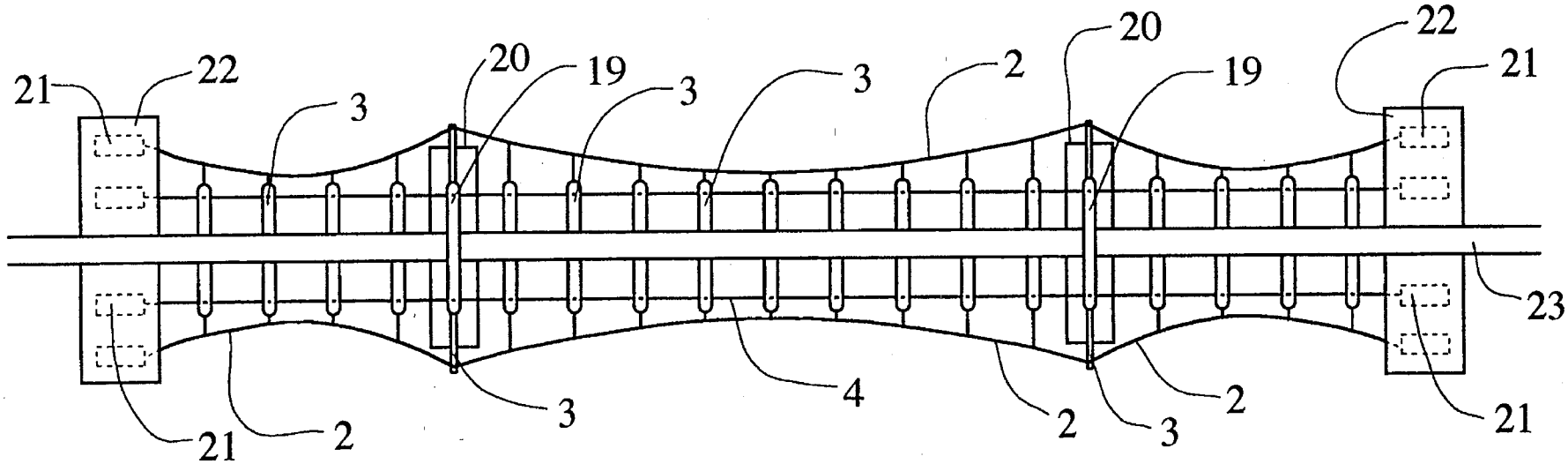
FIG. 3 is a view of the structure of FIG. 2 from above.

FIG. 3, is FIG. 2 viewed from above. The position of horizontal cable 2, main cable 4 and arch cable 8 may take the same position, however it is usually better to take a different position to obtain stronger tension. By means of FIG. 3, the horizontal cable 2 is set in a position different from the main cable 4 and anchor cable 21. The lateral girder/node member 3 at the tower 19 and the anchor 21 not only fulfill their primary functions, but also give tension to the horizontal cable 2 through strategic positioning of the ends of this cable 2 to the lateral girder/node member 3 located at the tower 19 and the anchor 21. According to FIG. 3 the lateral girder/node member 3 should be connected to the horizontal cable 2, except at the tower and the anchor. It is through these connections and bindings that high tensile strength is generated to the horizontal cable 2, as well as to the bridge itself, resulting in the bridge obtaining its high stiffness.

Figure 4:
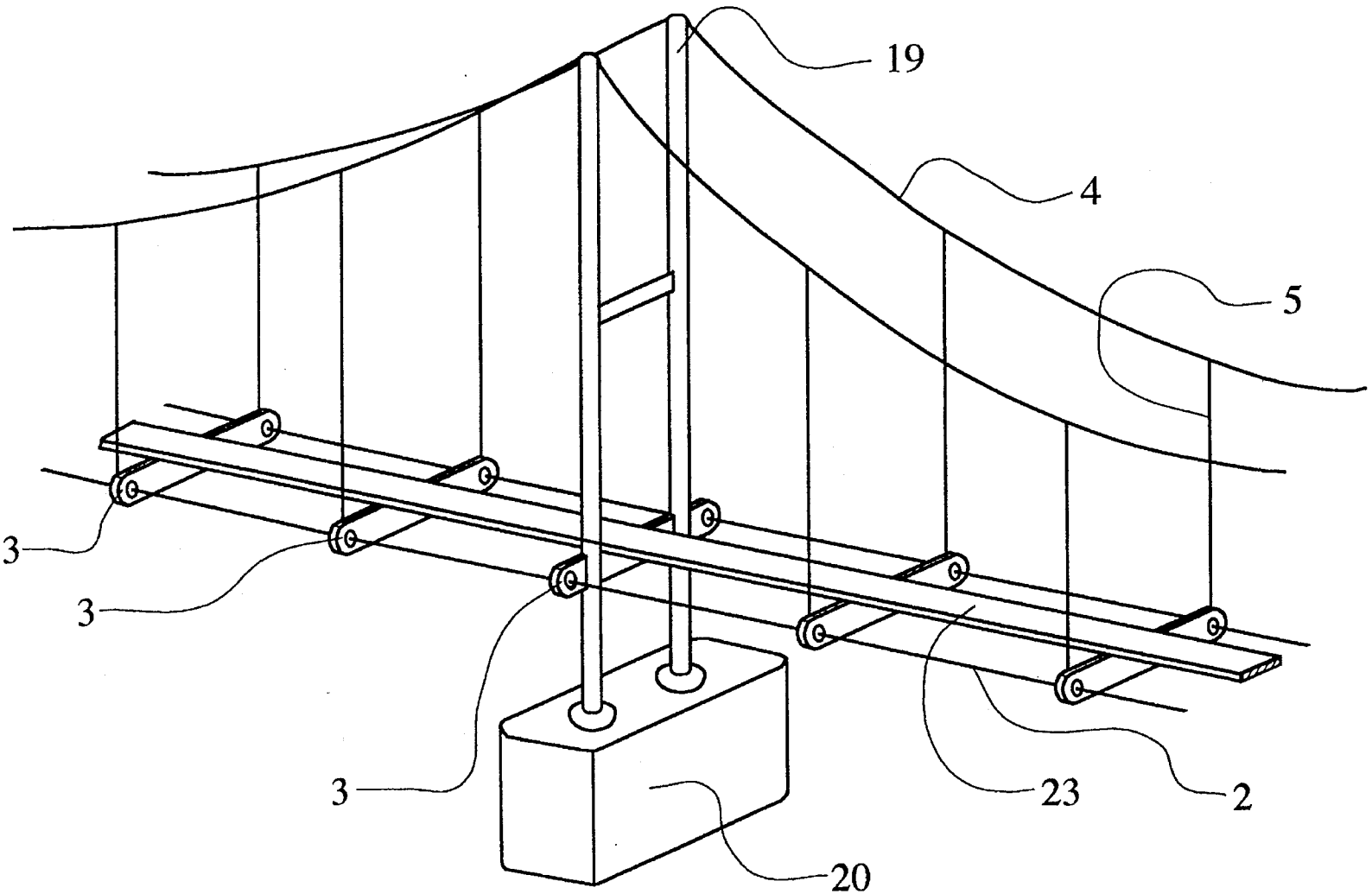
FIG. 4 illustrates the suspension bridge embodiment of the present invention without an arch cable.

FIG. 4 shows the case of suspension bridge which is lacking arch cable 8. The figure is a bird's-eye view around the tower 19. The frame lateral girder/node member 3 is hung by the main cable 4 and hanger 5. Meanwhile, the lateral girder/node member 3 is fixed in between the span by the horizontal cable 2. The new transportation system is then installed onto the lateral girder/node member 3. The tower 19 is combined with the lateral girder/node member 3. The distance between horizontal cables 2 is wider than that of the tower. Due to the increased width, it is possible to obtain larger geometrical moment of inertia and tensile force. Consequently, the stiffness of the frame of the bridge becomes stronger.

Figure 5:
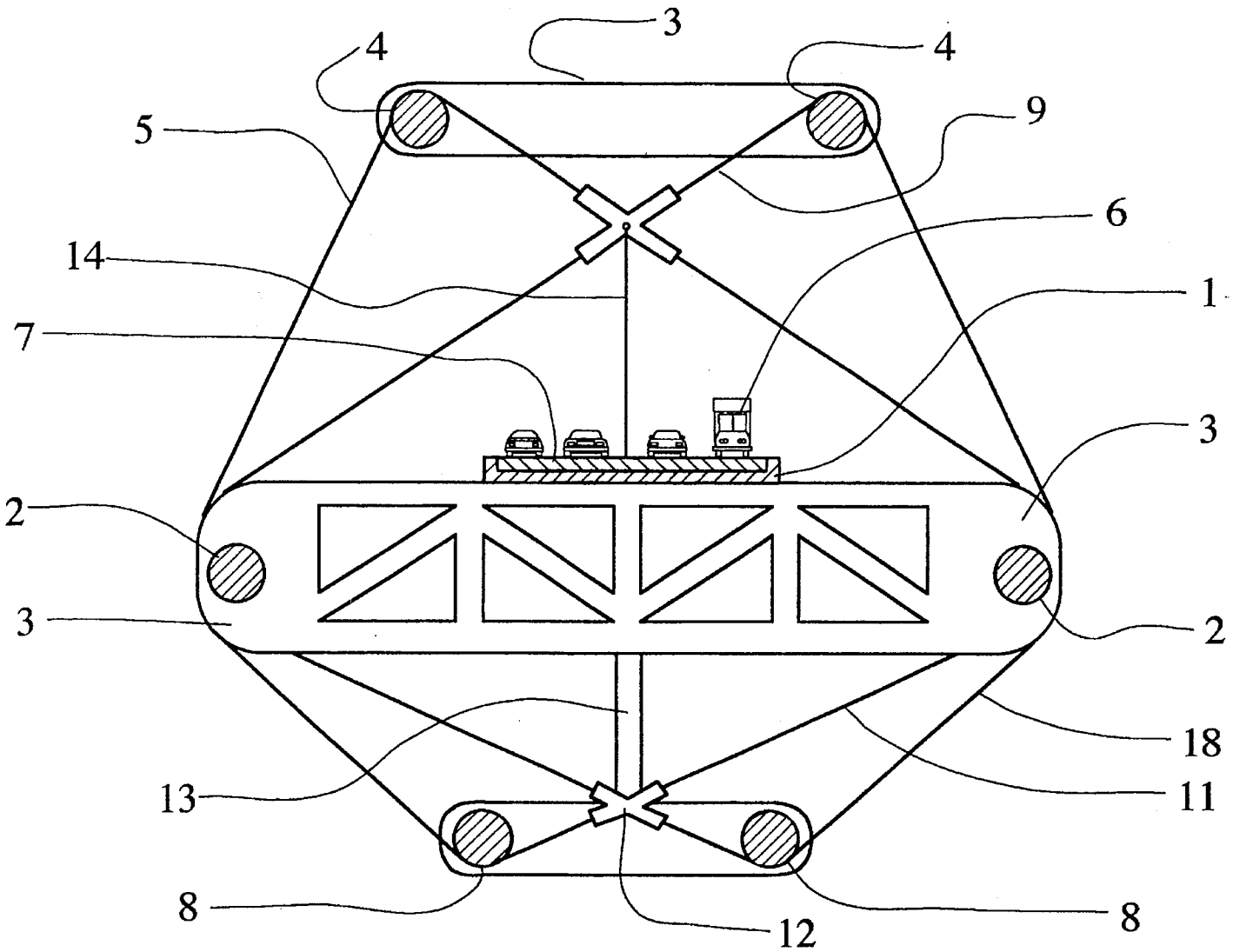
FIG. 5 shows a cross section of the central span area of the suspension bridge embodiment of the present invention.

FIG. 5 shows a cross section of central span area of the suspension bridge. The frame lateral girder/node member 3, which connects the main cables 4 and the horizontal cables 2, and the other lateral girder/node member which connects right and left arch cables 8, are installed. When a load is put on the lateral girder/node member 3, the lateral girder/node member will maintain its position because the main cable 4, frame lateral girder/node member 3, and upper hanger 9 are connected. Likewise, arch cable 8 and frame lateral girder/node member 3 are connected and the lower hanger 1 and lower cross hanger joint 12 are connected for added stiffness. Central support 13 sustains the bridge floor 11 from below. Additionally, the support is connected with the lower cross hanger 12. This example identifies the road for automobiles as a bridge floor, however, the bridge floor can be railroad or any type of transportation system. By means of FIG. 5, the road for automobile is shown. In this case, automobile 6 are running on the road 7. The bridge floor 1 is hung by the central hanger 14 which is connected with an upper cross hanger connector 10.

Figure 6:
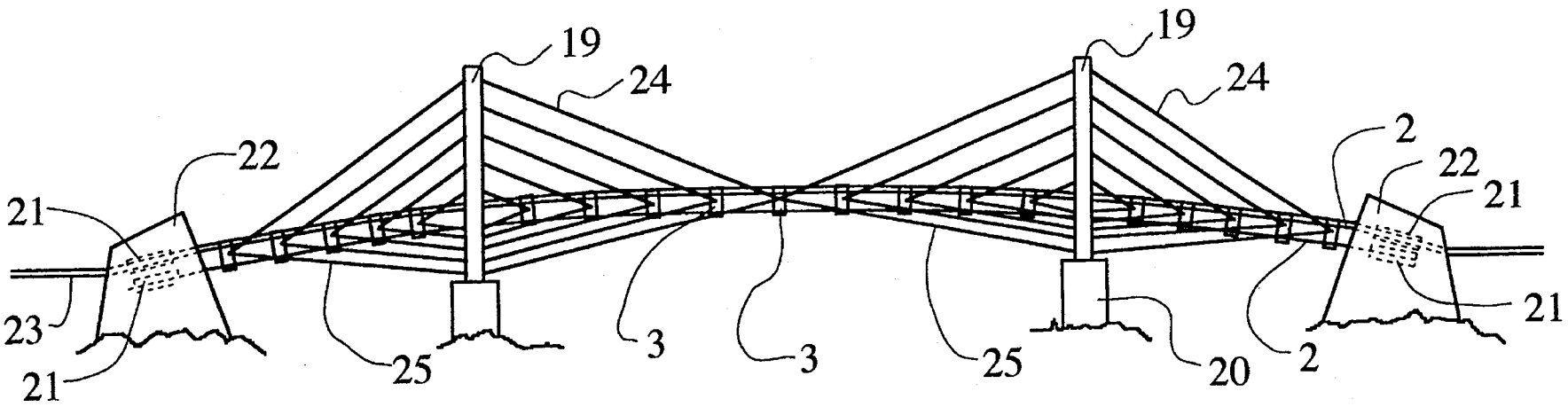
FIG. 6 illustrates a cable-stayed embodiment of the present invention.

FIG. 6 shows the case of cable-stayed bridge. The tower 19 is constructed upon the bridge pier 20. Horizontal cable 2 is fixed at the place of anchorage 22 by the anchor 21 to obtain tensile force. The frame lateral girder/node member 3 is pulled by the upper stayed cable 24 and the lower stayed cable 25 toward the tower 19, however the lateral girder/node member 3 is also pulled by horizontal cable 2 to be balanced. The bridge floor 1 is constructed onto the frame lateral girder/node member 3. The frame lateral girder/node member 3 are arranged in a longitudinal direction forming bone-like frame. The frame of the bridge structure will then obtain a highly pre-tensioned force through the horizontal cable 2, upper stayed cable 24 which is hung from the tower 19 and the lower stayed cable 25. The road for automobiles is installed on the frame lateral girders/node member 3 which are arranged in a longitudinal direction with the bridge floor. In the case of FIG. 6, the position of the starting point of upper stayed cable 24 and lower stayed cable 25 from the tower 19 is inside the width of the tower 19, however, it is not necessary that the starting point should be within the width of the tower.

Figure 7:
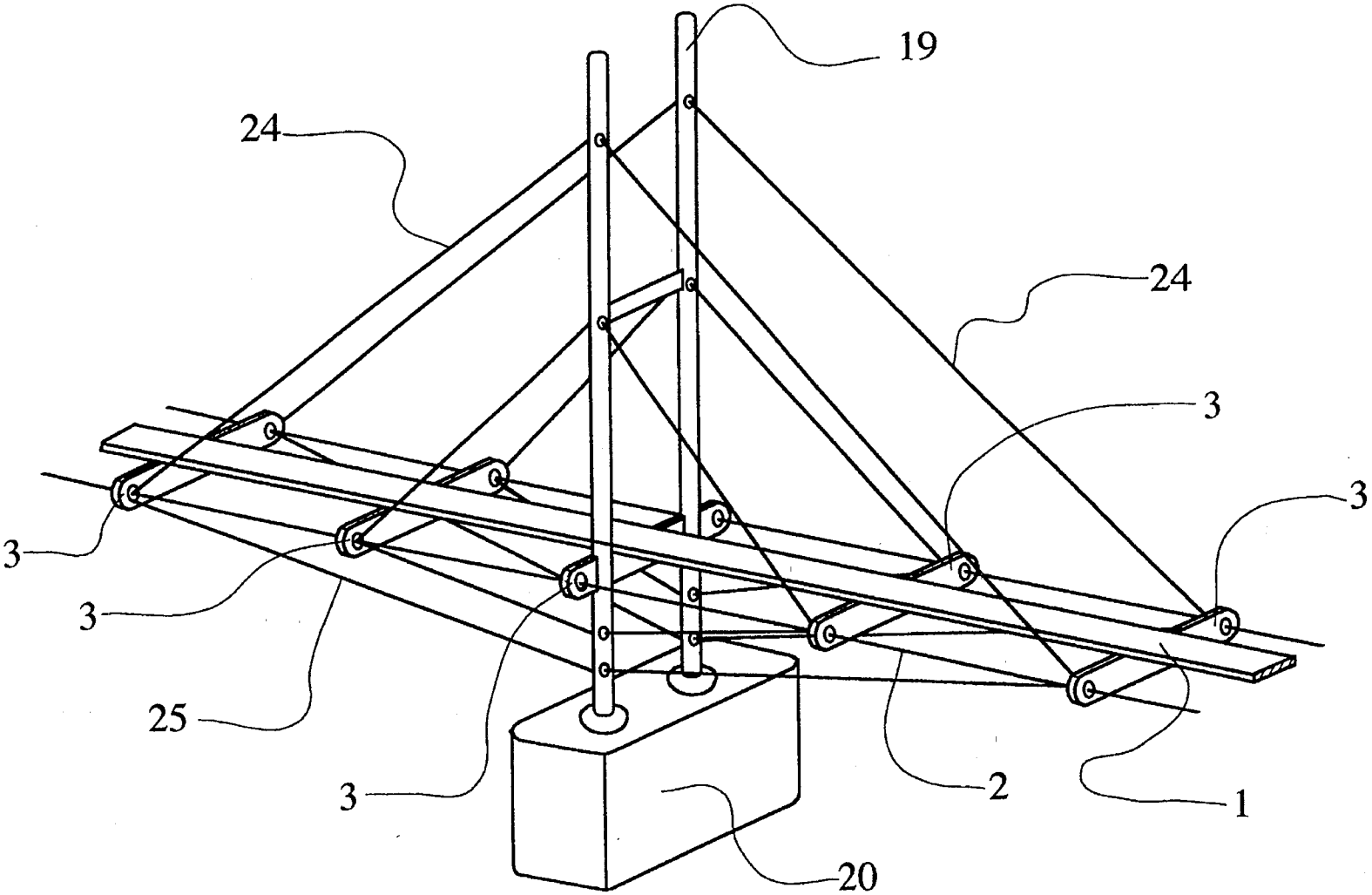
FIG. 7 is a bird's-eye view in the vicinity of the tower portion of the cable-stayed embodiment of FIG. 6.

FIG. 7 is a bird's-eye view around the tower 19 of a cable-stayed bridge. The frame lateral girders/node members 3 are installed by the upper stayed cable 24 and the lower stayed cable 25 and the horizontal cable 2. Upon the lateral girder/node member 3, the bridge floor 1 is installed. At the tower 19, the lateral girder/node member 3 and the tower 19 are actually one unit (i.e. the tower 19 has a built in lateral girder/node member 3). The width of both sides of the horizontal cable 2 is wider than that of the tower 19. The increased width will create a larger geometrical moment of inertia and tensile force. The strength of bridge structure then becomes much stronger than conventional cable-stayed bridge.

Therefore, many modifications and embodiments of this specific invention will come to mind to one skilled in the art by having the teachings presented in the foregoing description and accompanying drawings of this invention and hence it is to be understood that the invention is not therefore limited and that such modifications, etc., are intended to be included in the scope of the appended claims.

What is claimed is:

1. In a cable-stayed bridge structure positioned between anchorages, especially of the type having a bridge floor for a transportation system and a bridge pier positioned beneath the bridge floor, comprised of a first plurality of generally horizontally oriented cables which extend between and are coupled under tension to the anchorages;

a tower section which protrudes from said bridge pier and between the horizontal cables, and to which the horizontal cables are attached;

a first frame lateral girder/node member, which is spaced apart from said tower section and positioned between and in a connecting relationship with said horizontal cables to form a frame; and an upper stayed cable connecting an upper portion of said tower to said first frame lateral girder/node member;

wherein tension applied by said upper stayed cable to said first frame lateral girder/node member is opposed by tension applied by the first plurality of horizontal cables, and said bridge floor can be supported by said first frame lateral girder/node member.

2. The cable-stayed bridge of claim 1, a second plurality of generally horizontally oriented cables positioned below the first plurality of generally horizontally oriented cables and which extend between and are coupled under tension to the anchorages and to the tower section and frame lateral girder/node member.

3. The cable-stayed bridge of claim 1, a lower stayed cable which connects a lower portion of said tower and said frame lateral girder/node member.

4. The cable-stayed bridge of claim 1, additional frame lateral girder/node members, each spaced apart from said tower section and the first frame lateral girder/node member, and positioned between and in a connecting relationship with said horizontal cables at a location along the horizontal cables to form an associated frame.

5. The cable-stayed bridge of claim 1, wherein the tower section includes a built in frame lateral girder/node member to which the plurality of horizontal cables are connected.

6. A cable-stayed bridge structure positioned between anchorages, especially of the type having a bridge floor for a transportation system and a bridge pier positioned beneath the bridge floor, comprising a plurality of generally horizontally oriented cables which extend between and are coupled under tension to the anchorages;

a tower section which protrudes from said bridge pier and between the horizontal cables, and to which the horizontal cables are attached;

a plurality of frame lateral girder/node members, which are spaced apart from said tower section and positioned between and in a connecting relationship with said plurality of horizontal cables, wherein each of the plurality of frame lateral girder/node members is spaced apart from one another and positioned along the horizontal cables to form frames with the horizontal cables;

a plurality of upper stayed cables connecting upper portions of said tower to said plurality of frame lateral girder/node members; and a plurality of lower stayed cables connecting lower portions of said tower to said plurality of frame lateral girder/node members;

wherein tension applied by said upper and lower stayed cables to said first frame lateral girder/node member is opposed by tension applied by the first plurality of horizontal cables, and said bridge floor can be supported by said first frame lateral girder/node member.

7. A method of constructing a cable-stayed bridge structure of the type which is positioned between anchorages, especially of the type having a bridge floor for a transportation system and a bridge pier positioned beneath the bridge floor, comprising the steps of (a) installing a plurality of horizontal cables between the anchorages so that the plurality of horizontal cables are under tension;

(b) positioning a tower on the bridge pier and between the plurality of horizontal cables;

(c) positioning a frame lateral girder/node member between and in a connecting relationship with the plurality of horizontal cables;

(d) connecting an upper portion of said tower to said frame lateral girder/node member with an upper stayed cable to apply an upward tension on said lateral girders/node member;

(e) further tensioning said horizontally oriented cables and said upper stayed cable so that the tension applied to the frame lateral girder/node member by the horizontal cables is balanced against the tension applied by the upper stayed cable; and (f) installing said transportation system onto said frame lateral girder/node member.

8. The method of claim 7 further including the step of (e) connecting a lower portion of said tower to said frame lateral girder/node member with an lower stayed cable to apply a downward tension on said lateral girders/node member.

* * * * *